US011329416B2

(12) United States Patent
Kim et al.

(10) Patent No.: US 11,329,416 B2
(45) Date of Patent: May 10, 2022

(54) CONNECTOR APPARATUS

(71) Applicants: HYUNDAI MOTOR COMPANY, Seoul (KR); KIA MOTORS CORPORATION, Seoul (KR)

(72) Inventors: Jong Soo Kim, Hwaseong-si (KR); Yong Soo Jung, Incheon (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 17/078,746

(22) Filed: Oct. 23, 2020

(65) Prior Publication Data

US 2022/0021147 A1 Jan. 20, 2022

(30) Foreign Application Priority Data

Jul. 14, 2020 (KR) ..... 10-2020-0087014

(51) Int. Cl.
*H01R 13/436* (2006.01)
*H01R 13/506* (2006.01)

(52) U.S. Cl.
CPC ..... *H01R 13/4362* (2013.01); *H01R 13/506* (2013.01)

(58) Field of Classification Search
CPC ..... H01R 13/4362; H01R 13/4361; H01R 13/506
See application file for complete search history.

(56) References Cited

U.S. PATENT DOCUMENTS 5,252,096 A * 10/1993 Okada ..... H01R 13/4362 439/752
5,464,356 A * 11/1995 Nebeshima ..... H01R 13/4362 439/752
5,653,613 A * 8/1997 Shimoda ..... H01R 13/4361 439/752

FOREIGN PATENT DOCUMENTS

KR 10-2008-0044046 A 5/2008

* cited by examiner

*Primary Examiner* — Briggitte R. Hammond
(74) *Attorney, Agent, or Firm* — Lempia Summerfield Katz LLC

(57) ABSTRACT

A connector apparatus includes a housing having an upper surface portion formed with an accommodation space, and a position assurance to be inserted into the accommodation space of the housing. When the position assurance is mounted in the housing, a mounting portion of the position assurance is exposed on a side surface portion of the housing, such that visibility at the time of work is improved. In addition, the position assurance is connected to the housing in a catching structure, such that it is easy to mount and demount the position assurance and mounting strength is secured.

9 Claims, 11 Drawing Sheets

CONNECTOR APPARATUS

CROSS REFERENCE TO RELATED APPLICATION

This application claims priority to and the benefit of Korean Patent Application No. 10-2020-0087014, filed on Jul. 14, 2020, the entire contents of which are incorporated herein by reference.

FIELD

The present disclosure relates to a connector apparatus including a terminal position assurance (TPA).

BACKGROUND

The statements in this section merely provide background information related to the present disclosure and may not constitute prior art.

A connector may perform electrical connection by coupling with a mating connector. The connector may be formed by installing a terminal formed of a conductive material, inside a housing formed of an insulating material.

A force may be applied to the terminal installed inside the housing of the connector in a process in which the connector is coupled to or decoupled from the mating connector or by other external forces. In order to assure a position of the terminal from the force, a terminal position assurance (TPA) may be used. The terminal position assurance may be locked to the housing to support a part of the terminal, thereby fixing the position of the terminal installed inside the housing.

However, we have discovered that when a rework is desired to separate the terminal position assurance locked to the housing from the housing, the connector is easily damaged due to an excessive external force applied to the connector at the time of performing such a rework.

In addition, since a terminal position assurance according to the related art has a structure in which it is inserted and buried from an upper side of the housing toward a lower side of the housing, it is difficult to demount the terminal position assurance from the housing when the rework is required.

The contents described as the related art have been provided only to assist in understanding the background of the present disclosure and should not be considered as corresponding to the related art known to those having ordinary skill in the art.

SUMMARY

The present disclosure provides a connector apparatus to improve convenience of handling a terminal position assurance (TPA).

According to one form of the present disclosure, a connector apparatus includes: a housing formed with opening holes through which terminals are inserted in a front and rear direction, and including an upper surface portion formed with an accommodation space laterally extending toward a side surface portion and depressed downward from the upper surface portion, where the side surface portion includes an installation portion disposed on an extension line of the accommodation space and extending downward from an upper end of the side surface portion; and a position assurance configured to be inserted into the accommodation space from above the housing to be mounted in the housing, and including: through-holes configured to communicate with the opening holes when the position assurance is mounted to the housing, a side end portion extending downward from an upper surface of the position assurance and connected to the installation portion, and a mounting portion mounted on the side end portion and configured to have a bent shape. In particular, when the position assurance is mounted in the housing, the installation portion of the housing is inserted between the side end portion and the mounting portion of the position assurance, such that the side end portion is positioned inside the installation portion and the mounting portion is exposed outside the installation portion.

The installation portion may be depressed inward from the side surface portion so that the mounting portion is buried in the side surface portion when the position assurance is mounted in the housing.

The mounting portion may include a first extending portion extending outward from an upper end of the side end portion and then bent downward and a second extending portion continuously extending downward from a bent portion of the first extending portion and having a width smaller than that of the first extending portion.

The installation portion may include a seating space which extends downward from the upper end of the side surface portion and into which the first extending portion is inserted and a catching space which extends downward from the seating space and into which the second extending portion is inserted.

A support end protruding toward the catching space to be in contact with a lower end of the first extending portion and a front end or a rear end of the second extending portion may be formed in the side surface portion, and the first extending portion may be seated on the support end when the position assurance is mounted in the housing.

A catching portion facing the catching space may be formed in the side surface portion, and a connection portion matched to the catching portion and caught by and connected to the catching portion may be formed in the second extending portion of the mounting portion.

The catching portion may be a plurality of grooves spaced apart from each other in a vertical direction in the catching space, and the connection portion may be a projection protruding to be inserted into one of the plurality of grooves.

A plurality of projections constituting the connection portion may be formed to be spaced apart from each other along the first extending portion so as to be matched to the plurality of grooves, respectively.

The first extending portion may have chamfer portions formed by recessing a front end and a rear end of the first extending portion, and protrusion portions protruding toward the seating space and inserted into the chamfer portions may be formed in the side surface portion.

The catching space may extend in an opposite direction to a portion where the catching portion is formed, such that a space is secured so that the second extending portion is bent and deformed.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
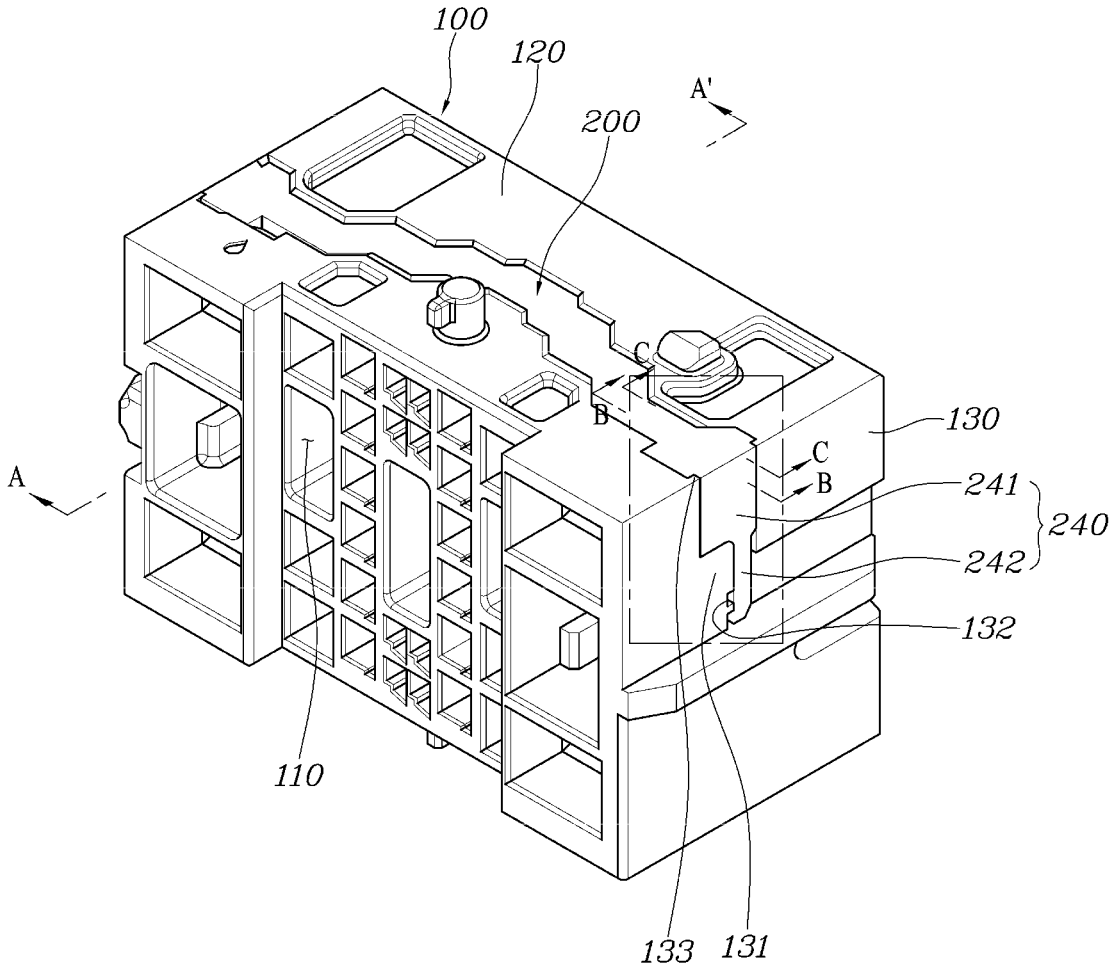
FIG. 1 is a perspective view illustrating a connector apparatus according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, a connector apparatus according to exemplary forms of the present disclosure will be described with reference to the accompanying drawings.

Figure 2:
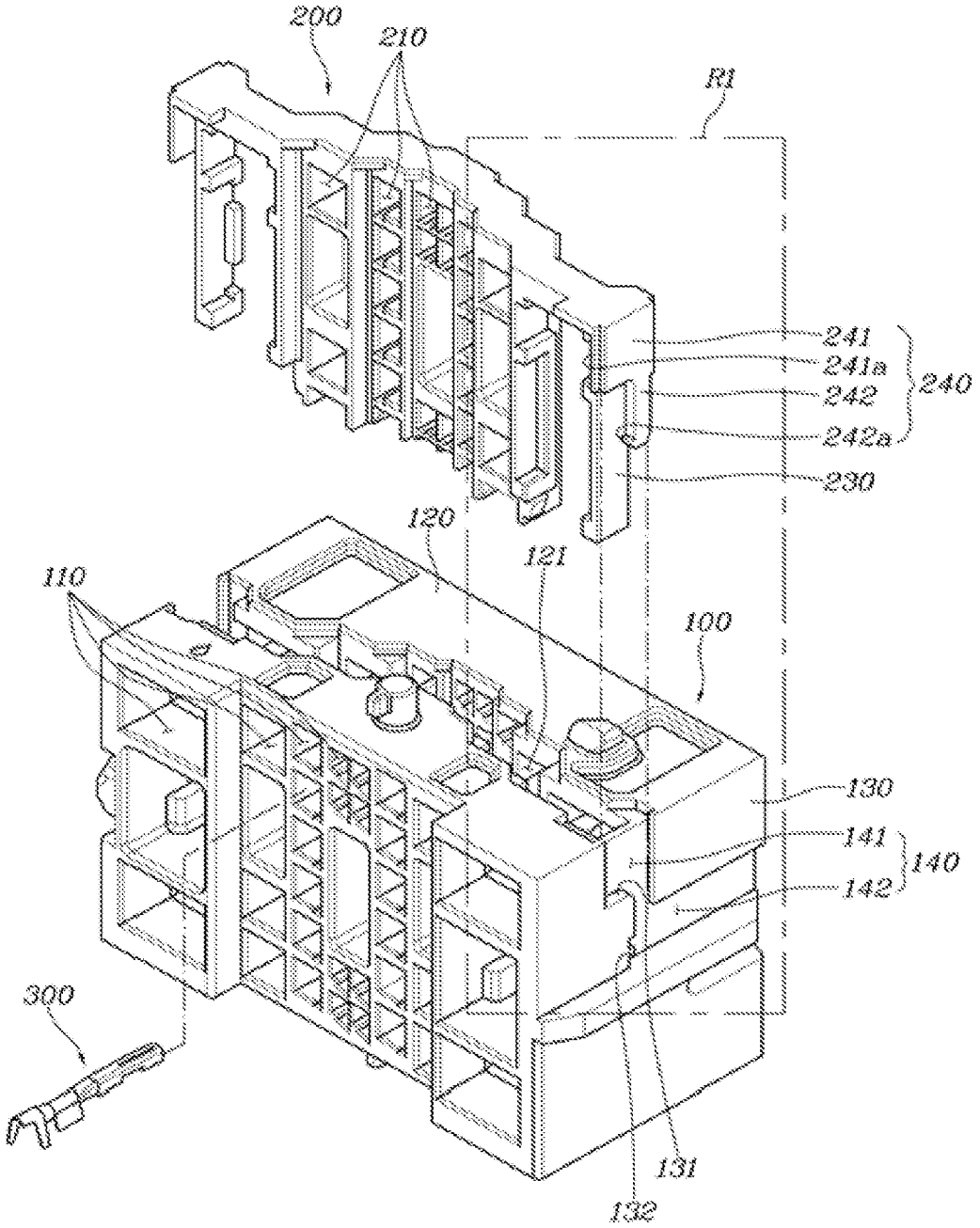
FIG. 2 is an exploded perspective view of the connector apparatus illustrated in FIG. 1.
Figure 3:
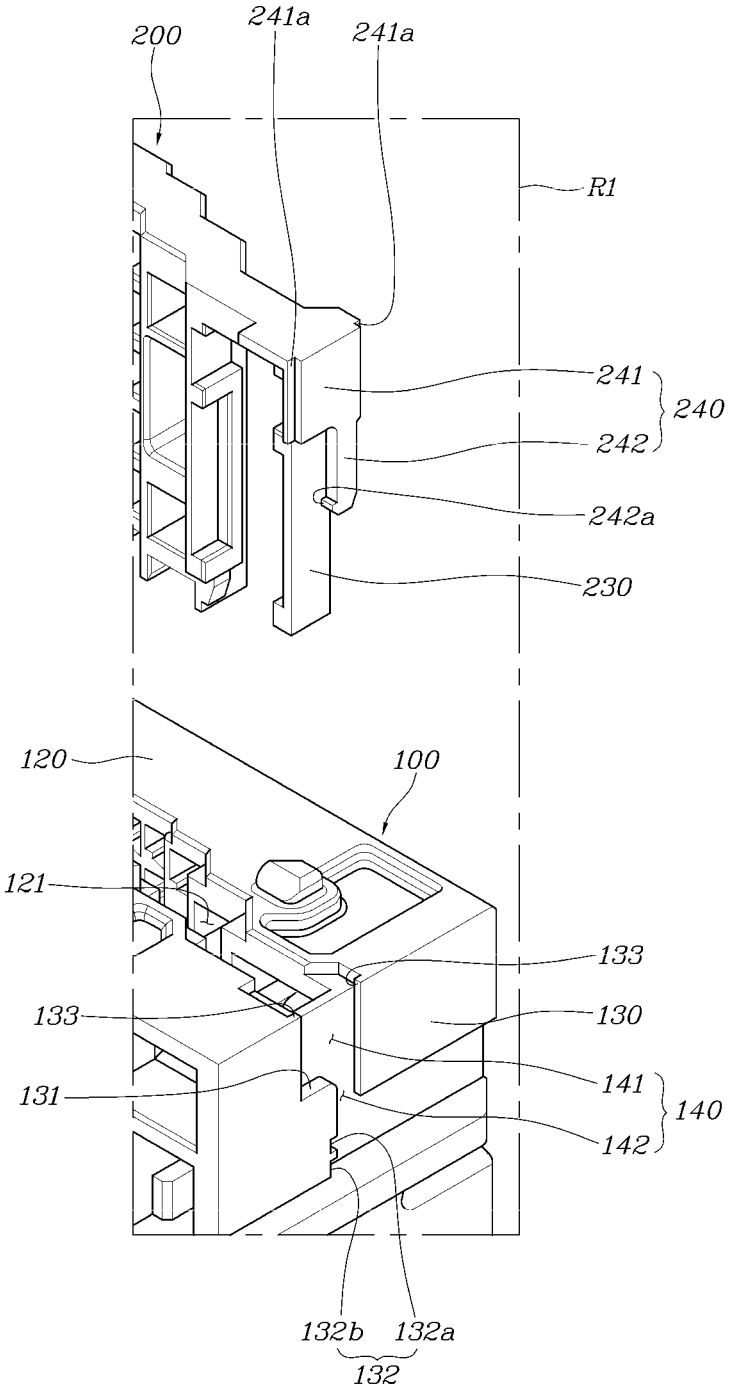
FIG. 3 is an enlarged view of region R1 of the connector apparatus illustrated in FIG. 2.
Figure 4:
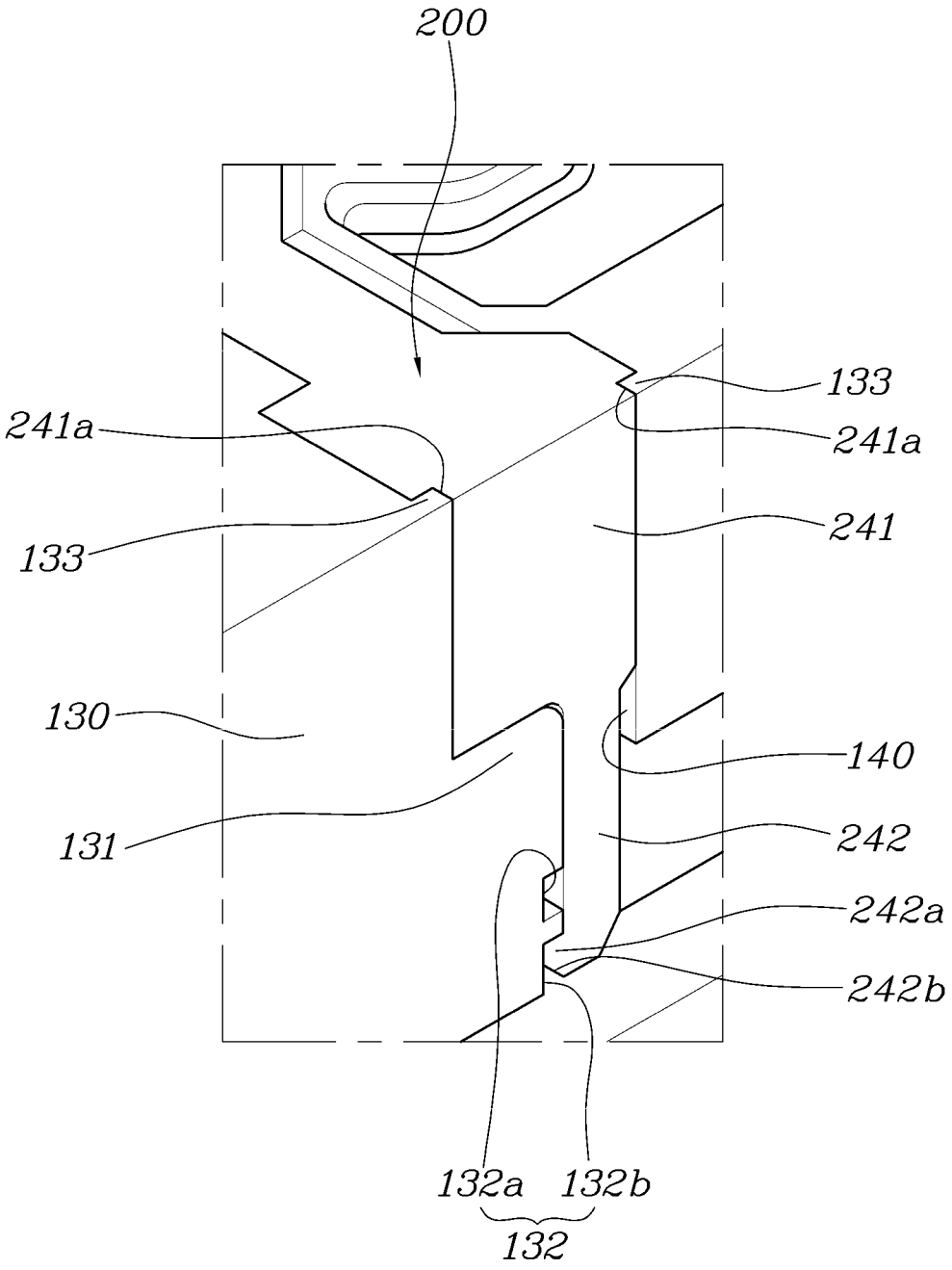
FIG. 4 is a view for describing a mounting portion and an installation portion of the connector apparatus illustrated in FIG. 1.
Figure 5:
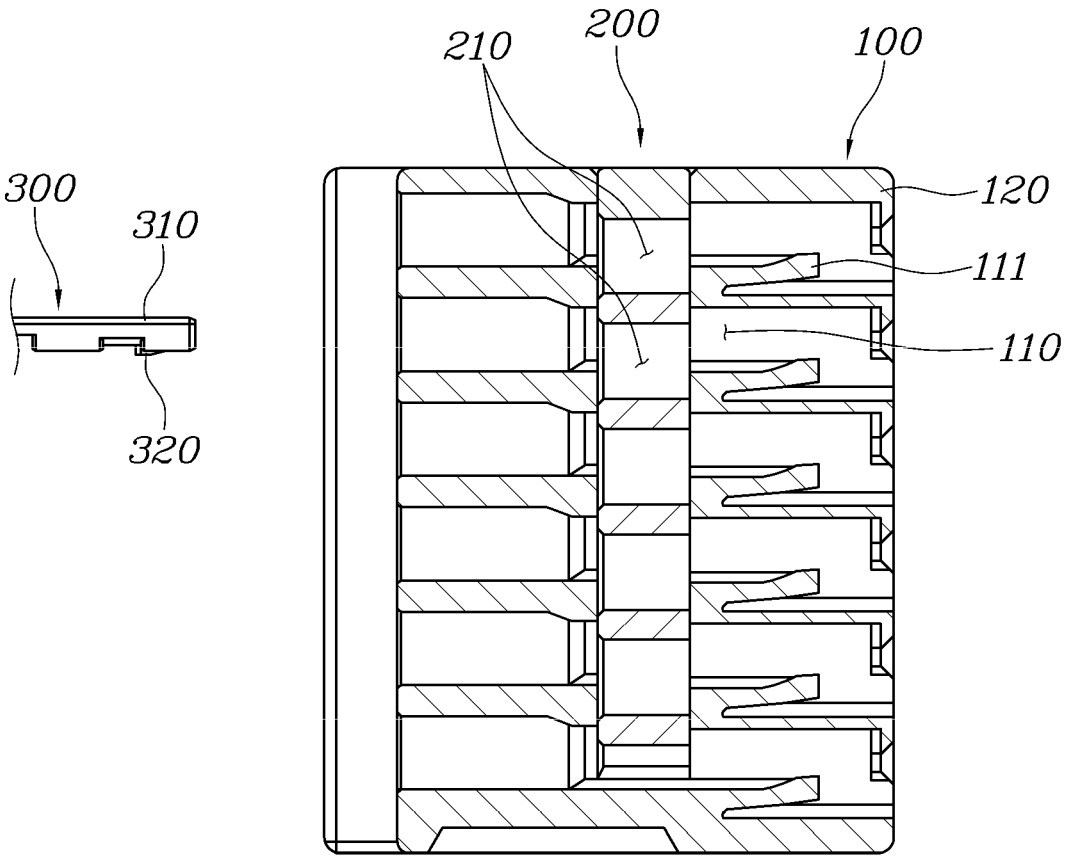
FIG. 5 is a cross-sectional view taken along line A-A' of the connector apparatus illustrated in FIG. 1.
Figure 6:
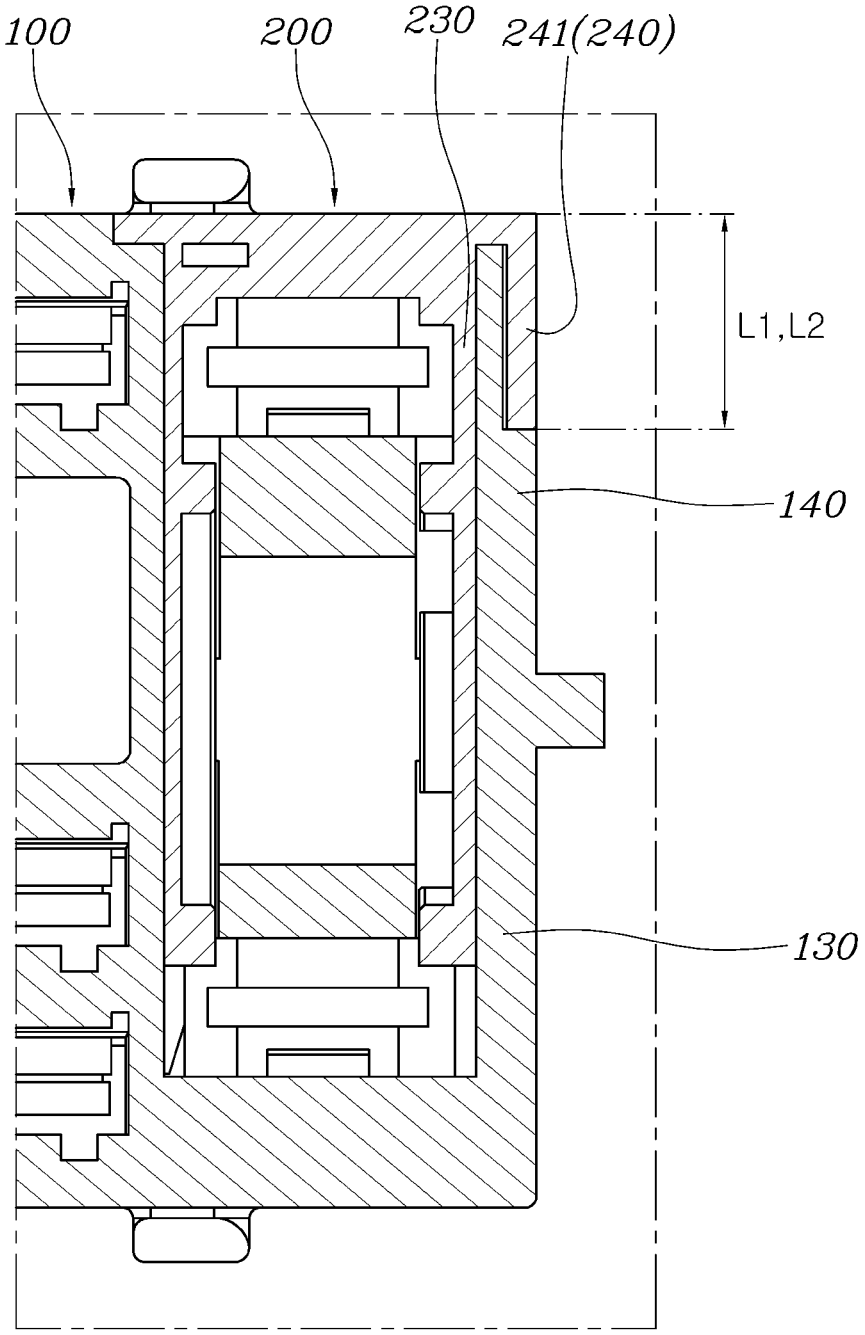
FIG. 6 is a cross-sectional view taken along line B-B' of the connector apparatus illustrated in FIG. 1.
Figure 7:
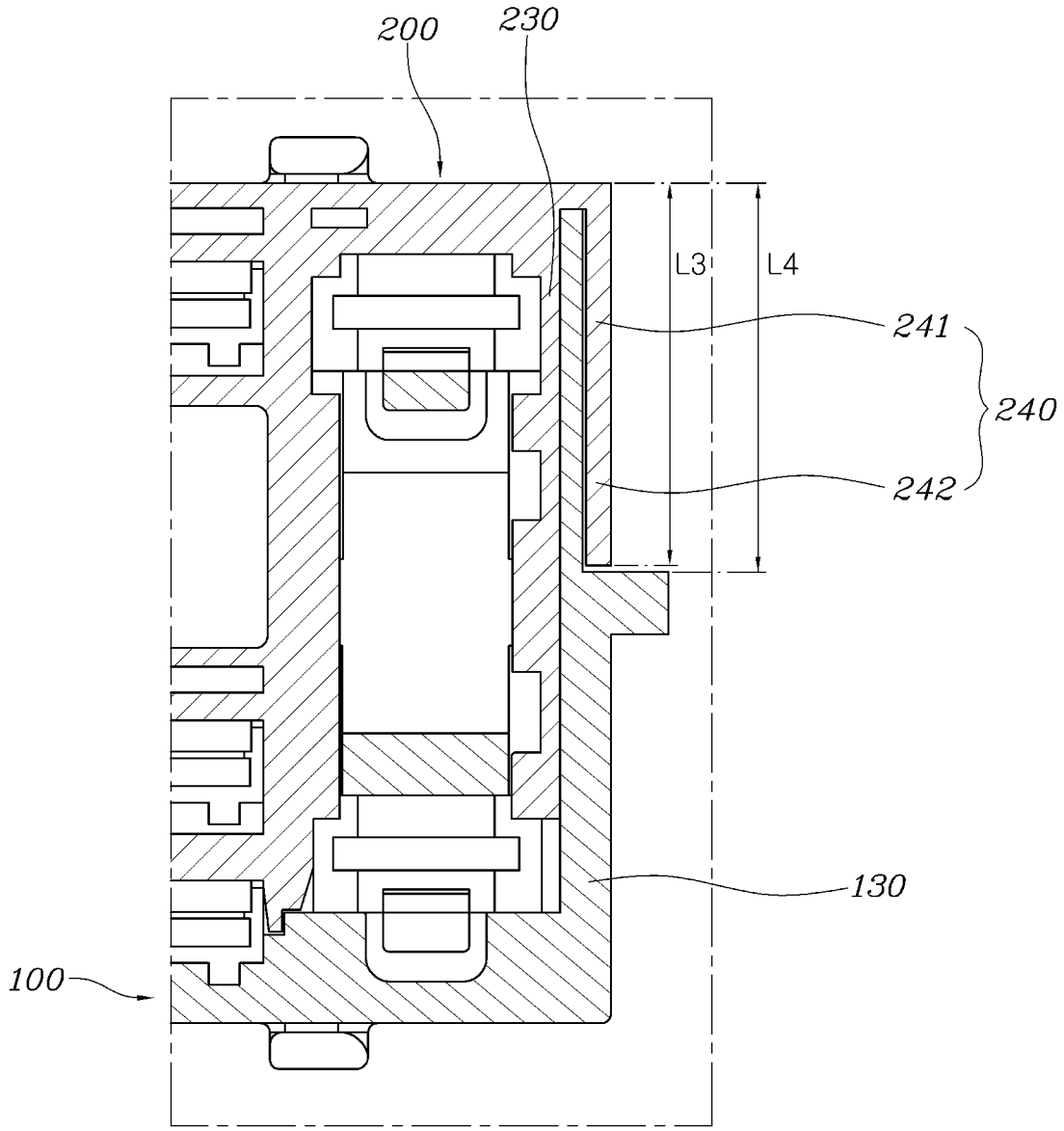
FIG. 7 is a cross-sectional view taken along line C-C' of the connector apparatus illustrated in FIG. 1.

FIG. 1 is a perspective view illustrating a connector apparatus according to one form of the present disclosure, FIG. 2 is an exploded perspective view of the connector apparatus illustrated in FIG. 1, FIG. 3 is an enlarged view of region R1 of the connector apparatus illustrated in FIG. 2, FIG. 4 is a view for describing a mounting portion and an installation portion of the connector apparatus illustrated in FIG. 1, FIG. 5 is a cross-sectional view taken along line A-A' of the connector apparatus illustrated in FIG. 1, FIG. 6 is a cross-sectional view taken along line B-B' of the connector apparatus illustrated in FIG. 1, FIG. 7 is a cross-sectional view taken along line C-C' of the connector apparatus illustrated in FIG. 1, and FIGS. 8 to 10 are views for describing the sequence of mounting the connector apparatus illustrated in FIG. 1.

In one form of the present disclosure, the connector apparatus includes: a housing 100 which is formed with opening holes 110 through which terminals 300 are inserted in a front and rear direction, and has an upper surface portion 120 formed with an accommodation space 121 laterally extending toward a side surface portion 130 and depressed downward from the upper surface portion, and which has the side surface portion 130 in which an installation portion 140 disposed on an extension line of the accommodation space 121 and extending downward from an upper end of the side surface portion 130 is formed; and a position assurance 200 which is inserted from above the housing 100 into the accommodation space 121 to be mounted in the housing 100, includes through-holes 210 formed to communicate with the opening holes 110 when the position assurance 200 is mounted to the housing, and has a side end portion 230 extending downward from an upper surface of the position assurance 200 and connected to the installation portion 140, as illustrated in FIGS. 1 and 2. In one form, a mounting portion 240 is mounted on the side end portion 230 and has a bent shape.

Here, the housing 100 may accommodate the terminal 300. That is, the opening holes 110 in which the terminals 300 are inserted are formed in the housing 100, and the terminals 300 may be inserted along the opening holes 110 to be mounted inside the housing 100. As such, the terminal 300 installed inside the housing 100 may be coupled to a mating connector to perform electrical connection.

As illustrated in FIG. 5, the housing 100 may include a lance 111 in the opening hole 110. Therefore, when the terminal 300 is mounted in the opening hole 110 of the housing 100, the lance 111 may be fastened and fixed to a projection portion 320 protruding from a base portion 310 of the terminal 300, and the terminal 300 may be coupled to a mating connector in a state where it is mounted in the housing 100.

The terminal 300 is inserted into the housing 100 through the opening hole 110, and the accommodation space 121 extending laterally toward the side surface portion 130 and depressed downward is formed in the upper surface portion 120 of the housing 100 to allow the position assurance 200 to be mounted. Here, the installation portion 140 disposed on the extension line of the accommodation space 121 and extending downward from the upper end is formed in the side surface portion 130 of the housing 100. Therefore, the position assurance 200 inserted into the accommodation space 121 may be fixed through the installation portion 140.

Therefore, the position assurance 200 is inserted from above the housing 100 into the accommodation space 121 to be mounted in the housing 100, includes the through-holes 210 formed to communicate with the opening holes 110 at the time of mounting the position assurance 200, and has the side end portion 230 on which the mounting portion 240 bent and extending downward and connected to the installation portion 140 is formed. Here, the mounting portions 240 may be provided on both side end portions 230 of the position assurance 200. Therefore, the installation portions 140 may be formed on both side surface portions 130 of the housing 100. Therefore, the through-hole 210 of the position assurance 200 communicates with the opening hole 110, such that the terminal 300 may pass through the through-hole 210 of the position assurance 200.

That is, the position assurance 200 is inserted from above the housing 100 into the accommodation space 121, and is fixed to the installation portion 140 of the housing 100 through the mounting portion 240 formed on the side end portion 230, such that a mounting position of the position assurance 200 is fixed.

Particularly, when the position assurance 200 is mounted in the housing 100, the installation portion 140 of the housing 100 is inserted between the side end portion 230 and the mounting portion 240 of the position assurance 200, such that the side end portion 230 is positioned inside the installation portion 140 and the mounting portion 240 is exposed outside the installation portion 140. As such, in the present disclosure, when the position assurance 200 is mounted in the housing 100, the position assurance 200 is fixed to the installation portion 140 through the side end portion 230 and the mounting portion 240, and the mounting portion 240 is exposed outside the installation portion 140, such that it is easy to mount and demount the position assurance 200.

As described above, in the present disclosure, when the position assurance 200 is mounted in the housing 100, the side end portion 230 of the position assurance 200 is in contact with the inside of the installation portion 140, such that strength is ensured, and the mounting portion 240 of the position assurance 200 is exposed outside the installation portion 140, such that a work for mounting and demounting the position assurance 200 through the mounting portion 240 is easy, and work convenience is thus ensured.

The present disclosure described above will be described in detail. As illustrated in FIG. 3, the installation portion 140 may be depressed inward from the side surface portion 130 so that the mounting portion 240 is buried in the side surface portion 130 when the position assurance 200 is mounted in the housing 100.

As such, the installation portion 140 is formed in a shape in which it is depressed from the side surface portion 130 of the housing 100, such that the mounting portion 240 is seated to be buried in the installation portion 140 when the position assurance 200 is mounted in the housing 100. Therefore, as illustrated in FIG. 1, in a state where the position assurance 200 is mounted in the housing 100, the side surface portion 130 of the housing 100 and the mounting portion 240 of the position assurance 200 form a flat surface, such that a difference in an appearance is solved. In addition, the mounting portion 240 of the position assurance 200 does not protrude from the side surface portion 130 of the housing 100, such that demounting of the position assurance 200 by an unintentional external force is prevented.

Meanwhile, as illustrated in FIGS. 3 and 4, the mounting portion 240 may include a first extending portion 241 extending outward from an upper end of the side end portion 230 and then bent downward and a second extending portion 242 continuously extending downward from a bent portion of the first extending portion 241 and having a width smaller than that of the first extending portion 241 in the front and rear direction.

In addition, the installation portion 140 may include a seating space 141 which extends downward from the upper end of the side surface portion 130 and into which the first extending portion 241 is inserted and a catching space 142 which extends downward from the seating space 141 and into which the second extending portion 242 is inserted.

That is, the mounting portion 240 of the position assurance 200 includes the first extending portion 241 and the second extending portion 242, the first extending portion 241 is formed in a shape where it extends outward from the side end portion 230 and is then bent downward, and the second extending portion 242 is formed in a shape where it extends downward from a lower end of the first extending portion 241. Therefore, the installation portion 140 includes the seating space 141 into which the first extending portion 241 is inserted and the catching space 142 into which the second extending portion 242 is inserted, and the seating space 141 and the catching space 142 may be formed so that the first extending portion 241 and the second extending portion 242 may be inserted thereinto, respectively.

Here, the mounting portion 240 is formed to have a width decreasing as it goes downward because a width of the first extending portion 241 is larger than that of the second extending portion 242. In the present disclosure, the first extending portion 241 is to prevent the position assurance 200 from being separated from the installation portion 140 and secure strength when the position assurance 200 is mounted in the housing 100, and is formed so that a width thereof in the front and rear direction is secured. The second extending portion 242 is a portion coupled and fixed to the housing 100 when the position assurance 200 is mounted in the housing 100, and the second extending portion 242 is formed to have a relatively small width in the front and rear direction so that partial deformation thereof is allowed.

In addition, as illustrated in FIG. 6, a length L1 of the first extending portion 241 in a vertical direction is the same as a length L2 of the seating space 141 in the vertical direction, such that the first extending portion 241 may be seated in the side surface portion 130 when the position assurance 200 is mounted in the housing 100. In addition, as illustrated in FIG. 7, a length L3 of the first extending portion 241 and the second extending portion 242 in the vertical direction may be shorter than a length L4 of the seating space 141 and the catching space 142 to prevent the mounting portion 240 from interfering with the side surface portion 130 at a lower side of the installation portion 140.

Therefore, the position assurance 200 may be mounted in the housing 100 in a state where the first extending portion 241 and the second extending portion 242 constituting the mounting portion 240 are matched, respectively, to the seating space 141 and the catching space 142 constituting the installation portion 140 of the housing 100.

A mounting structure of the position assurance 200 and the housing 100 will be described in detail. As illustrated in FIG. 4, a support end 131 protruding toward the catching space 142 to be in contact with the lower end of the first extending portion 241 and a front end or a rear end of the second extending portion 242 is formed in the side surface portion 130, and the first extending portion 241 may be seated on the support end 131 when the position assurance 200 is mounted in the housing 100. The support end 131 may be generated since widths of the seating space 141 and the catching space 142 are different from each other. That is, the support end 131 of the side portion 130 protrudes toward the catching space 142, such that the lower end of the first extending portion 241 is seated on an upper end of the support end 131 when the mounting portion 240 is mounted in the installation portion 140. Therefore, when the position assurance 200 is seated in the housing 100, a position of the mounting portion 240 is restricted by the support portion 131, such that the position assurance 200 may be correctly positioned. In addition, the lower end of the first extending portion 241 and the front end or the rear end of the second extending portion 242 are in contact with the support end 131, such that mounting strength is secured. It has been illustrated in FIG. 4 that the front end of the second extending portion 242 is in contact with the support end 131, but a portion in contact with the support end 131 may be changed according to a design.

Figure 8:
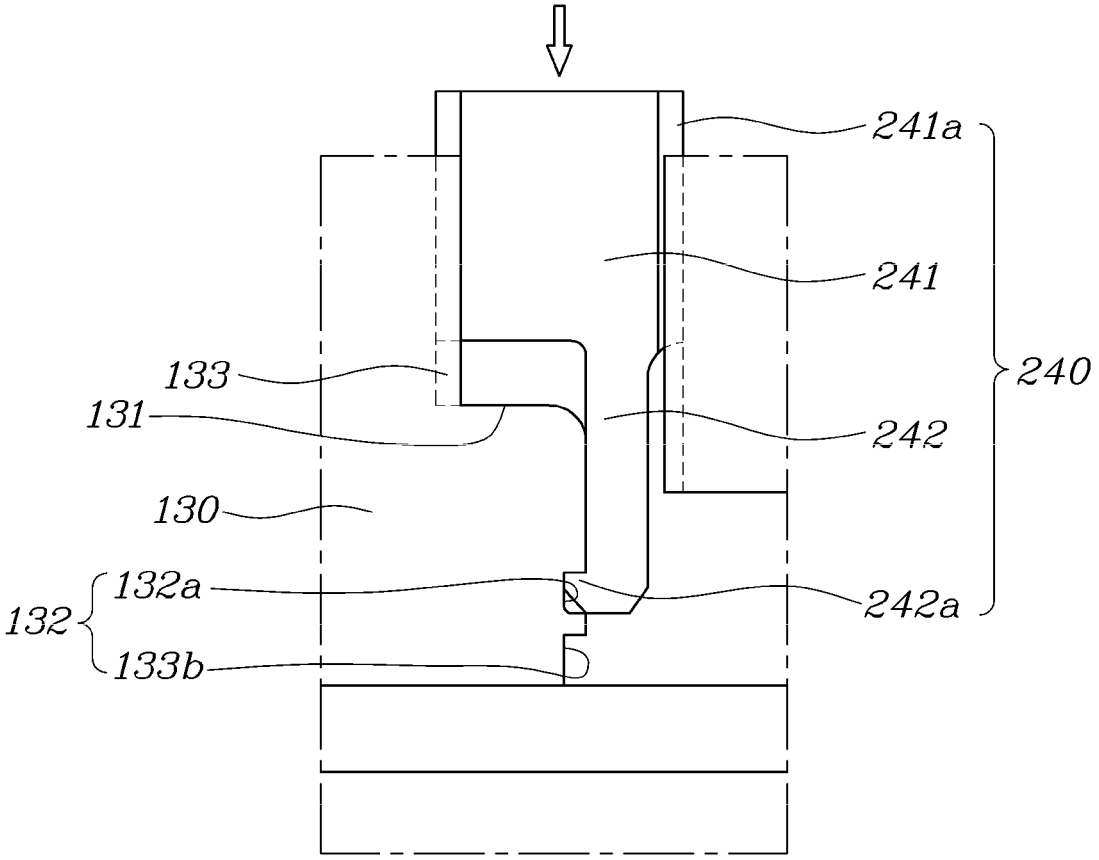
FIGS. 8 to 10 are views for describing the sequence of mounting the connector apparatus illustrated in FIG. 1.

Meanwhile, as illustrated in FIGS. 3 and 8, a catching portion 132 facing the catching space 142 may be formed in the side surface portion 130, and a connection portion 242*a* matched to the catching portion 132 and caught by and connected to the catching portion 132 may be formed in the second extending portion 242 of the mounting portion 240. Therefore, when the position assurance 200 is mounted in the housing 100, the second extending portion 242 of the mounting portion 240 is inserted up to the catching space 142, and the connection portion of the second extending portion 242 is caught by and connected to the catching portion 132 formed in the side surface portion 130, such that the second extending portion 242 may be fixed to the side surface portion 130. As described above, the second extending portion 242 is caught by the side surface portion 130 in the catching space 142, such that a position of the mounting portion 240 is fixed. As a result, the position assurance 200 is fixed to the housing 100 and is not separated from the housing 100.

Figure 9:
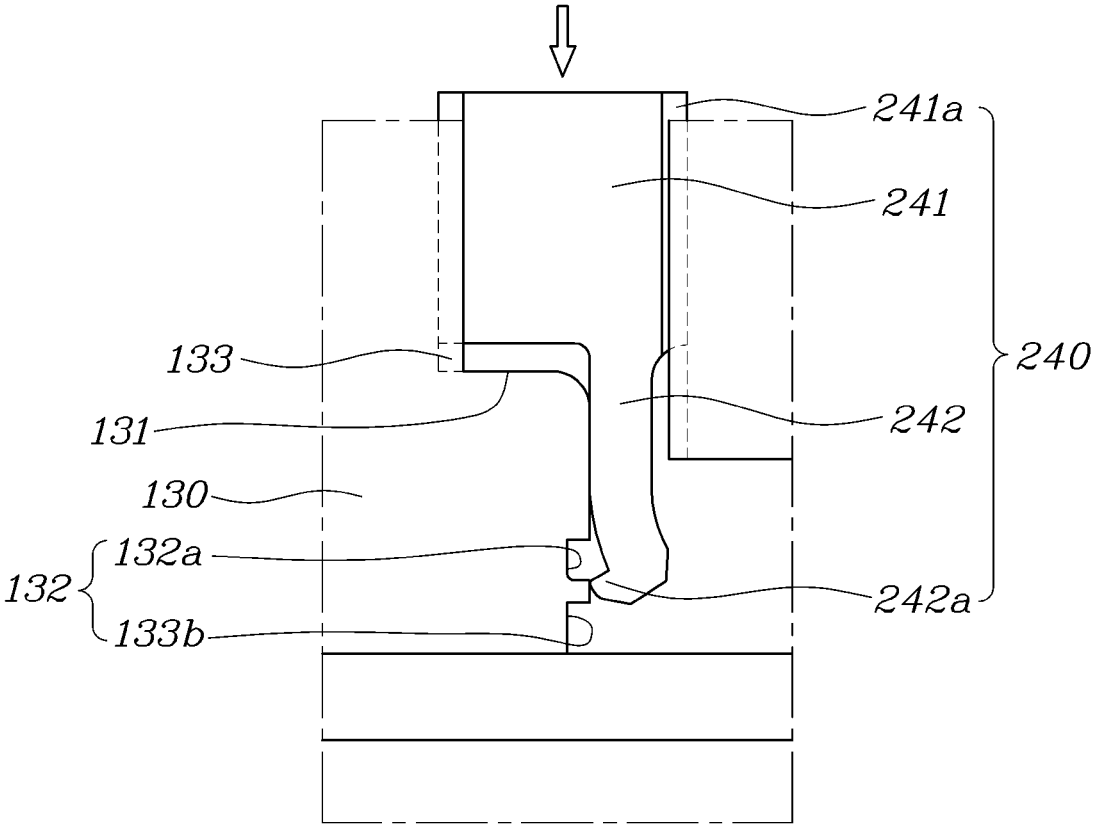
Figure 10:
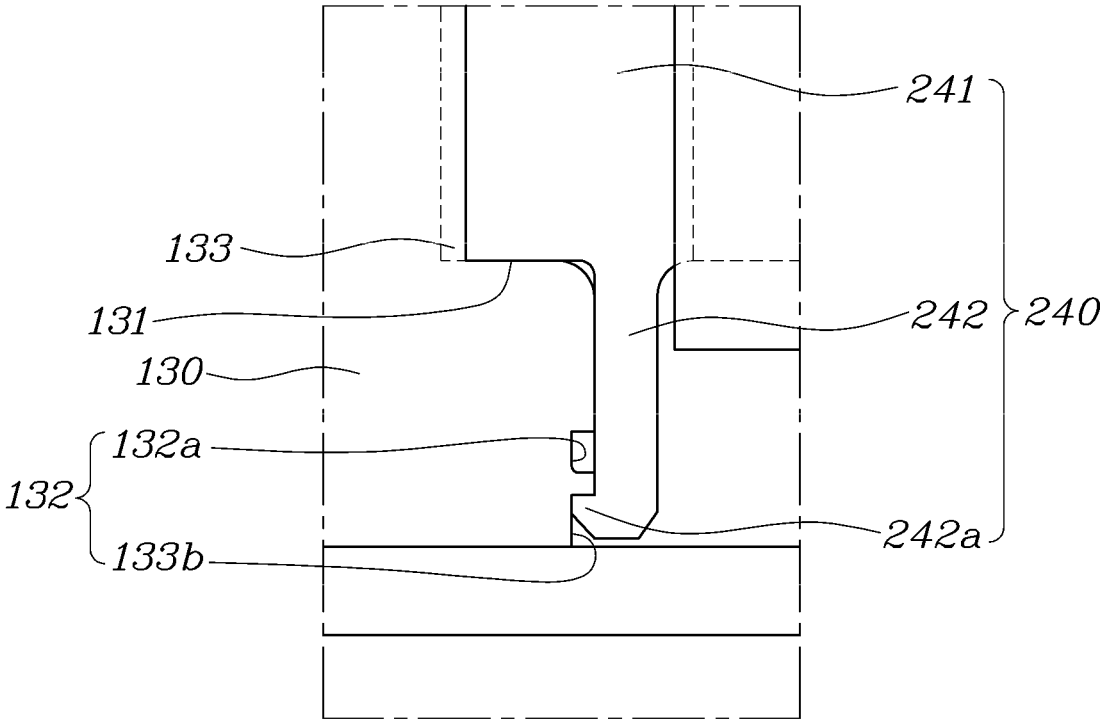

Here, the catching portion 132 is a plurality of grooves spaced apart from each other in the vertical direction in the catching space 142, and the connection portion 242*a* may be a projection protruding to be inserted into one of the plurality of grooves. As described above, the catching portion 132 and the connection portion 242*a* may form a catching structure constituted by the grooves and the projection, respectively, to be coupled to each other. Particularly, the catching portion 132 is constituted by the plurality of grooves spaced apart from each other in the vertical direction in the catching space 142, such that a fixed position of the mounting portion 240 may be determined according to a position at which the projection constituting the connection portion 242*a* is inserted into a specific groove. In one form of the present disclosure, the plurality of grooves constituting the catching portion 132 may include a first groove 132*a* and a second groove 132*b*. Therefore, before the terminal 300 is inserted into the housing 100, the position assurance 200 is inserted and temporarily fixed into the housing 100, and as illustrated in FIG. 8, the connection portion 242*a* formed in the mounting portion 240 of the position assurance 200 is fastened to the first groove 132*a*, such that primary locking may be performed. Subsequently, after the insertion of the terminal 300 is completed, the position assurance 200 is completely mounted in the accommodation space 121 of the housing 100, and as illustrated in FIG. 9, the mounting portion 240 moves downward, such that the connection portion 242*a* is separated from the first groove 132*a* while the second extending portion 242 is bent and deformed. Thereafter, as illustrated in FIG. 10, when the connection portion 242*a* is fastened to the second groove 132*b*, secondary locking may be performed.

Here, the catching space 142 extends in an opposite direction to a portion where the catching portion 132 is formed, such that a space may be secured so that the second extending portion 242 may be bent and deformed. That is, when the second extending portion 242 moves in the catching space 142, the catching portion 132 passes through the connection portion 242*a*, such that the second extending portion 242 is deformed, but the catching space 142 extends in the opposite direction to the portion where the catching space 142 is formed, such that the space is secured so that the second extending portion 242 may be bent and deformed, and the second extending portion 242 may thus be smoothly deformed. An extension length of such a catching space 142 may be determined according to a deformation amount of the second extending portion 242.

In addition, an inclination portion 242*b* having an inclination in a direction toward the catching portion 132 may be formed at a lower end of the projection constituting the connection portion 242*a*. Therefore, when the position assurance 200 is mounted in the housing 100, the projection constituting the connection portion 242*a* may smoothly move by climbing over the groove constituting the catching portion 132 in a direction in which the mounting portion 240 is installed in the installation portion 140, and is caught by the groove in an opposite direction, and thus, is not demounted.

Figure 11:
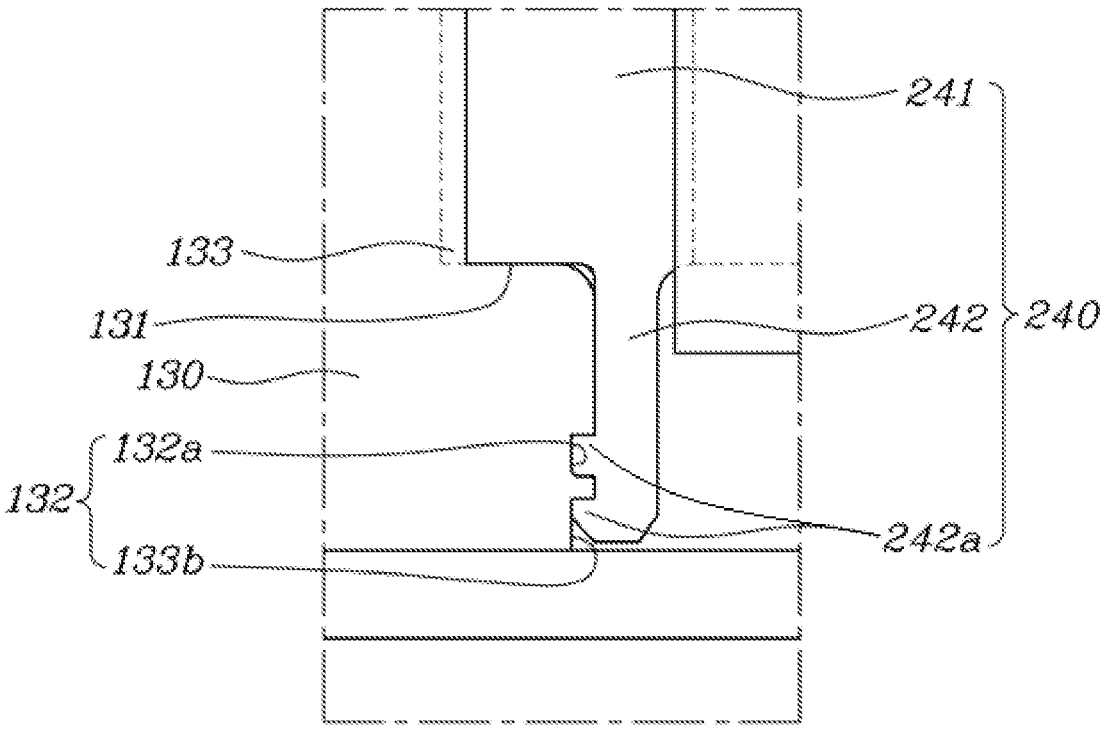
FIG. 11 is a perspective view illustrating a connector apparatus according to another form of the present disclosure.

As another example, as illustrated in FIG. 11, a plurality of projections constituting the connection portion 242*a* may be formed to be spaced apart from each other along the second extending portion 242 so as to be matched to the plurality of grooves, respectively. In a case where the number of projections constituting the connection portion 242*a* and the number of grooves constituting the catching portion 132 coincide with each other as described above, fastening strength between the connection portion 242*a* and the catching portion 132 is secured.

Meanwhile, as illustrated in FIGS. 3 and 4, the first extending portion 241 may have chamfer portions 241*a* formed by recessing a front end and a rear end of the first extending portion 241, and protrusion portions 133 protruding toward the seating space 141 and inserted into the chamfer portions 241*a* may be formed in the side surface portion 130. Here, the chamfer portions 241*a* extend from the front end and the rear end of the first extending portion 241 in the vertical direction, the protrusion portions 133 extend from the side surface portion 130 toward the seating space 141 in the vertical direction, and the chamfer portions 241*a* and the protrusion portions 133 form a sliding connection structure in the vertical direction.

Therefore, when the position assurance 200 is mounted in the housing 100, the chamfer portions 241*a* of the first extending portion 241 may be moved and inserted along the protrusion portions 133 formed in the side surface portion 130 of the housing 100. Particularly, the chamfer portions 241*a* of the first extending portion 241 are caught by the protrusion portions 133 of the housing 100, such that movement of the mounting portion 240 of the position assurance 200 to the outside is limited. Therefore, buckling of the mounting portion 240 due to widening of the mounting portion 240 to the outside is prevented, and mounting strength is secured.

The connector apparatus having the structure as described above is excellent in terms of visibility at the time of work since the mounting portion of the position assurance is exposed on the side surface portion of the housing when the position assurance is mounted in the housing. In addition, the position assurance is connected to the housing in a catching structure, such that it is easy to mount and demount the position assurance and mounting strength is secured.

Although the present disclosure has been shown and described with respect to specific forms, it will be apparent to those having ordinary skill in the art that the present disclosure may be variously modified and altered without departing from the spirit and scope of the present disclosure.

What is claimed is:

1. A connector apparatus comprising:

a housing formed with opening holes through which terminals are inserted in a front and rear direction, and including an upper surface portion formed with an accommodation space laterally extending toward a side surface portion of the housing and depressed downward from the upper surface portion, wherein the side surface portion includes an installation portion disposed on an end part of the accommodation space and extending downward from an upper end of the side surface portion; and a position assurance configured to be inserted into the accommodation space from above the housing to be mounted in the housing, and including:

through-holes configured to communicate with the opening holes when the position assurance is mounted to the housing;

a side end portion extending downward from an upper surface of the position assurance and connected to the installation portion; and a mounting portion mounted on the side end portion and configured to have a bent shape, wherein when the position assurance is mounted in the housing, the installation portion of the housing is between the side end portion and the mounting portion of the position assurance, such that the side end portion is positioned inside the installation portion and the mounting portion is exposed outside the installation portion, and wherein the mounting portion includes:

a first extending portion extending outward from an upper end of the side end portion and then bent downward; and a second extending portion continuously extending downward from a bent portion of the first extending portion and having a width smaller than a width of the first extending portion.

2. The connector apparatus of claim 1, wherein the installation portion is depressed inward from the side surface portion so that the mounting portion is buried in the side surface portion when the position assurance is mounted in the housing.

3. The connector apparatus of claim 1, wherein the installation portion includes:

a seating space which extends downward from the upper end of the side surface portion and into which the first extending portion is inserted; and a catching space which extends downward from the seating space and into which the second extending portion is inserted.

4. The connector apparatus of claim 3, wherein:

the side surface portion includes a support end protruding toward the catching space and configured to contact with a lower end of the first extending portion and a front end or a rear end of the second extending portion, and the first extending portion is seated on the support end when the position assurance is mounted in the housing.

5. The connector apparatus of claim 3, wherein the side surface portion includes a catching portion facing the catching space, and the second extending portion includes a connection portion configured to match to the catching portion and be caught by and connected to the catching portion.

6. The connector apparatus of claim 5, wherein the catching space is configured to extend in an opposite direction to a portion where the catching portion is formed, and provide a space to receive the second extending portion.

7. The connector apparatus of claim 5, wherein the catching portion comprises a plurality of grooves spaced apart from each other in a vertical direction in the catching space, and the connection portion is a projection protruding to be inserted into a groove of the plurality of grooves.

8. The connector apparatus of claim 7, wherein the connection portion comprises a plurality of projections and the projections of the plurality of projections are spaced apart from each other and are arranged to be inserted into corresponding grooves of the plurality of grooves, respectively.

9. The connector apparatus of claim 3, wherein the first extending portion has chamfer portions formed by recessing a front end and a rear end of the first extending portion, and the side surface portion includes protrusion portions configured to protrude toward the seating space and be inserted into the chamfer portions.

* * * * *